United States Patent [19]

Sakata et al.

[11] Patent Number: 4,696,630

[45] Date of Patent: Sep. 29, 1987

[54] SCROLL COMPRESSOR WITH A THRUST REDUCTION MECHANISM

[75] Inventors: Hirotsugu Sakata, Chigasaki; Shigemi Nagatomo; Makoto Hayano, both of Tokyo; Mitsuo Hatori, Yokohama, all of Japan

[73] Assignee: Kabushiki Kaisha Toshiba, Kawasaki, Japan

[21] Appl. No.: 903,872

[22] Filed: Sep. 2, 1986

Related U.S. Application Data

[63] Continuation of Ser. No. 655,429, Sep. 28, 1984, abandoned.

[30] Foreign Application Priority Data

Sep. 30, 1983 [JP] Japan ..... 58-180499

[51] Int. Cl.[4] ..... F04C 18/04; F04C 27/00; F04C 29/02

[52] U.S. Cl. ..... 418/55; 418/57; 418/88; 418/94

[58] Field of Search ..... 418/55, 57, 88, 94; 417/902

[56] References Cited

U.S. PATENT DOCUMENTS

| | | | |
|---|---|---|---|
| 3,600,114 | 8/1971 | Dvorak et al. | 418/57 |
| 3,884,599 | 5/1975 | Young et al. | 418/55 |
| 3,994,633 | 11/1976 | Shaffer | 418/55 |
| 4,343,599 | 8/1982 | Kousokabe | 418/55 |
| 4,431,380 | 2/1984 | Utter | 418/55 |
| 4,502,852 | 3/1985 | Hazaki | 418/55 |
| 4,645,437 | 2/1987 | Sakashita et al. | 418/57 |

*Primary Examiner*—John J. Vrablik

*Attorney, Agent, or Firm*—Oblon, Fisher, Spivak, McClelland, & Maier

[57] ABSTRACT

In a scroll compressor for compressing gas a scroll unit having stationary and orbiting scroll members with interfitting spiroidal wraps is hermetically enclosed in a housing. During operation, a compression chamber defined between the scroll chambers is given a high pressure, and the space in the housing below the orbiting scroll member is given a low pressure atmosphere. A motor housed in the low pressure atmosphere rotates a drive shaft. This drive shaft causes the orbiting scroll member to orbit. A passage is provided in the orbiting scroll member to connect the low pressure atmosphere and the compression chamber. A thrust reduction mechanism is supported by the housing in the low pressure atomophere. The thrust reduction mechanism receives the pressure of the compression chamber via the passage.

19 Claims, 26 Drawing Figures

SCROLL COMPRESSOR WITH A THRUST REDUCTION MECHANISM

This application is a continuation of application Ser. No. 655,429, filed Sept. 28, 1984, now abandoned.

FIELD OF THE INVENTION

This invention relates to a scroll compressor and, in particular, to an improvement in a scroll compressor with a scroll compressing unit housed in a sealed housing.

BACKGROUND OF THE INVENTION

Scroll compressors are well known as compressors for compressing the gas used in the cooling systems of refrigerators, freezers and air conditioners, etc. These scroll compressors have a scroll compressing unit with a pair of scroll members having interfitting spiroidal wraps. These scroll compressors are compact, highly efficient, and have low vibration, making them suitable for a wide range of applications.

This kind of scroll compressor has a sealed housing on the inside of which a frame, which divides the housing into upper and lower sections, is fastened. The scroll compressing unit is arranged on the upper part of this frame, and the motor for driving the scroll compressing arrangement is located on the lower part of the frame. Lubricating oil is collected at the bottom of the sealed housing.

In general, the scroll compressing unit consists of a stationary scroll member and an orbiting scroll member. The stationary scroll member and the orbiting scroll member have an end plate and a wrap projecting at right angles to the end plate. A shaft bearing passes through the frame and supports the rotary shaft of the motor.

A rotation transmission mechanism and an Oldham mechanism are provided between the upper part of the drive shaft and the orbiting scroll member to orbit the orbiting scroll member around the axis of rotation of the drive shaft.

As the space inside the motor equipped housing serves to separate the air and the liquid, the lower part of the orbiting scroll member is given a low pressure atmosphere, and the suction pipe is connected to this low pressure atmosphere. The upper part of the stationary scroll member is given a high pressure atmosphere, and the discharge pipe is connected to this high pressure atmosphere. Accordingly, a compression chamber is formed between the wraps of both the stationary scroll member and the orbiting scroll member, thereby forming a passage from the suction pipe to the discharge pipe via the compression chamber.

With this kind of construction, however, gas pressure inside the compression chamber increases as the orbiting scroll member orbits. Accordingly, the orbiting scroll member receives a downward thrust. In a 5-hp machine, this downward thrust may be as high as several hundred kilograms, resulting in an increase in the friction loss in the sliding part of the Oldham mechanism, for example. Because of this, the input must be increased, which increases the possibility of seizure. Also, when the downward thrust is large, the wraps of both the stationary scroll member and the orbiting scroll member are pressed in the axial direction to separate both scroll members from each other, resulting in a gap between the end plate of one of both scroll members and the wrap of the other, which in turn results in leakage of the pressurized gas.

In order to solve these two drawbacks, Eiji Sato in the U.S. application, Ser. No. 887,252, Mar. 16, 1978 proposed providing an intermediary chamber sealed off by the back surface of the orbiting scroll member. Part of the compressed gas from an intermediary compression chamber is fed into this intermediary chamber, and the orbiting scroll member is pressed against the stationary scroll member by the pressure of the gas in the intermediary chamber.

With this proposed device, however, the intermediary chamber is formed around the drive shaft of the motor, so a difference arises between the pressure in the housing and the pressure around the drive shaft. Consequently, when a centrifugal pump is employed at the motor drive in supplying lubricating oil to the individual friction parts, this pressure difference will result in over supply of oil to these parts, and in insufficient oil at the bottom of the housing. Also, it is necessary to use ball bearings and impregnated metal for the bearings in the friction parts around the drive shaft in the intermediary chamber. The reason for this is that, when the motor is started, there is no pressure difference between the housing and the intermediary chamber, and the result is insufficient lubrication between the bearing in the frame and the drive shaft. Accordingly, the construction for this type of compressor is complicated and the cost is high.

Tojo et al in U.S. Pat. No. 4,365,941, Apr. 30, 1980, proposes an intermediary chamber type compressor in which the bearing construction is simple. With this device, however, the previously mentioned drawback is not overcome. Moreover, because the discharge pipe is connected to the lower portion of the housing, which contains the motor, it is impossible to use the lower portion of the housing to separate the air and liquid.

OBJECTS OF THE INVENTION

A primary object of this invention is to provide a scroll compressor which can maintain the low pressure atmosphere on the lower side of the orbiting scroll member and which sufficiently suppresses the degree of thrust on the orbiting scroll member during operation, and to thereby prevent the leakage of high pressure gas, to prevent a reduction in input volume, and to prevent the seizure of the sliding parts.

A second object of the invention is to provide a scroll compressor which can provide sufficient lubrication between the drive shaft and the shaft bearing, etc., during start-up as well as during operation.

SUMMARY OF THE INVENTION

According to this invention, a scroll compressor comprises a housing having discharge and suction ports. A scroll compressing unit is located in the housing. The scroll compressing unit includes an orbiting scroll member and a stationary scroll member, both members having an end plate and wrap. The wraps mesh with each other, and a compression chamber is defined between the orbiting scroll member and the stationary scroll member. During operation, the gas passes through the suction port and the area around the orbiting scroll member to the compression chamber and from there to the discharge outlet in the central portion of the stationary scroll member and out the discharge port. The space in the housing below the end plate of the orbiting scroll member on the side opposite to the compression chamber is given a low pressure atmosphere which is lower than the compression chamber in pressure. The motor, which is housed in the low pressure atmosphere, rotates the drive shaft, and this drive shaft causes the orbiting scroll member to orbit through a biased small diameter shaft and an Oldham mechanism. A frame is fixed to the housing and to the periphery of the end plate of the stationary scroll member. This frame has a bearing hole into which the drive shaft is fitted. A passage is provided in the orbiting scroll member to connect the low pressure atmosphere and the compression chamber. A thrust reduction mechanism is supported by the housing in the low pressure atmosphere and receives the pressure of the compression chamber via the passage.

With the construction as described above, in particular with the provision of the thrust reduction mechanism, it is possible to sufficiently suppress the thrust on the orbiting scroll member and, thereby, to prevent the leakage of high pressure gas, to reduce the input, and to prevent seizure.

According to this invention, the sliding portion between the drive shaft and the bearing hole are in a low pressure atmosphere, which has the same pressure as the low pressure atmosphere within the housing. Accordingly, in order to be able to use a centrifugal pump and to supply lubrication oil to the sliding portion simultaneously with the start of the motor, it is possible to supply lubrication to the drive shaft and the bearing without using a special bearing construction, with few parts, and with an extremely simple structure.

DETAILED DESCRIPTION OF THE PREFERRED EMBODIMENTS

The following is a description with reference to drawings of the first embodiment of the sealed-type scroll compressor according to the invention.

Figure 1:
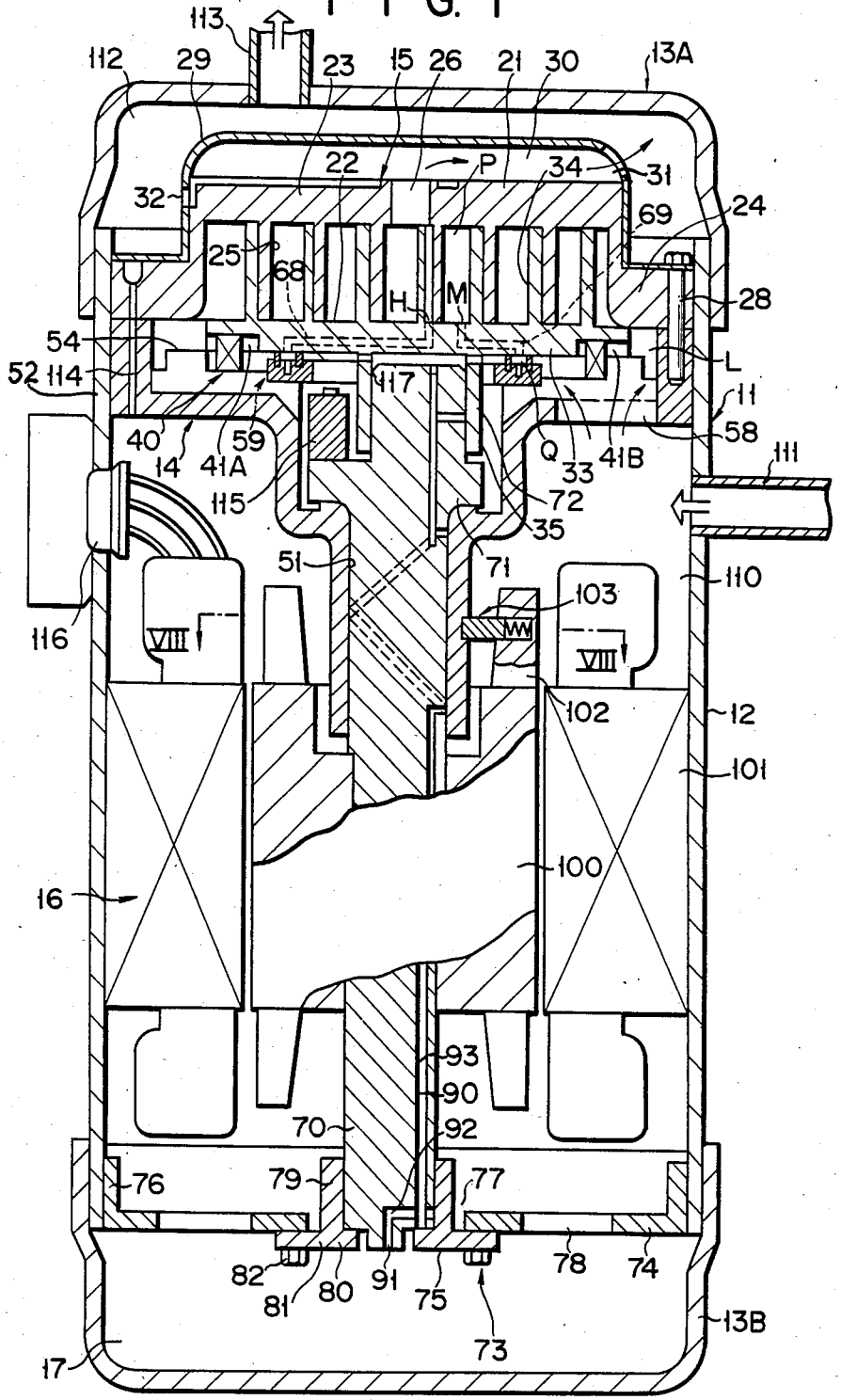
FIG. 1 is a schematic vertical cross section of the scroll compressor according to a first embodiment of the invention.

FIG. 1 is a simplified cross section of the sealed-type scroll compressor, which has a long sealed housing 11. The tube-shaped central portion 12 of the housing 11 is sealed by welding the upper and lower sealing members 13A and 13B at the end portions. A frame 14 is attached by its outside surface to the central portion 12, and at the upper portion of the frame 14 a scroll compressing unit 15 is located. A motor 16 is arranged at the lower portion of the frame 14. The motor 16 serves to drive the scroll compressing unit 15. Lubricating oil 17 is collected under the motor 16 at the bottom of the housing 11.

Figure 2A:
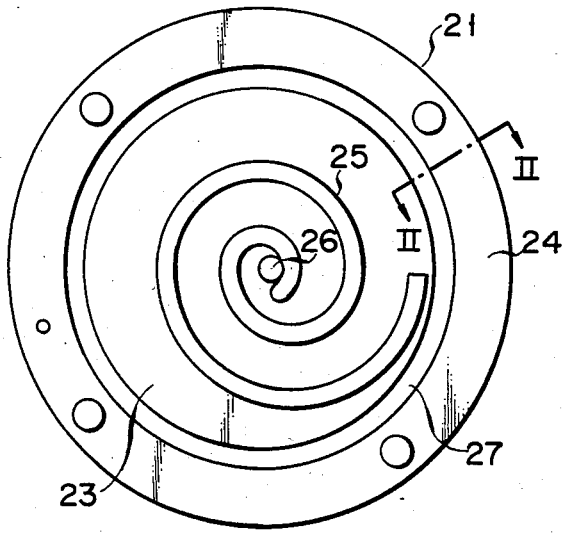
FIG. 2A is a schematic drawing of the lower side of the stationary scroll member of the scroll compressor of FIG. 1.
Figure 2B:
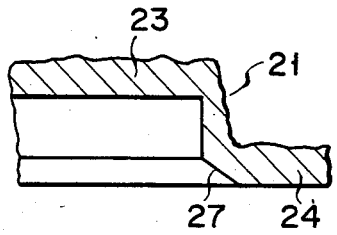
FIG. 2B is a partial cross section of the stationary scroll member along line II—II of FIG. 2A as seen in the direction of the arrow.

The scroll compressing unit 15 is constructed in a well known manner with a stationary scroll member 21 and an orbiting scroll member 22 located underneath it. The stationary scroll member 21 is constructed of a disc-shaped end plate 23, an annular wall 24, (which projects downwardly from the periphery of the end plate 23), a stationary wrap 25, (which is inside the area enclosed by the annular wall 24, and the lower surface of the end plate 23, which projects downwardly from the lower surface of the end plate 23, and which is substantially the same height as the annular wall 24), and a discharge port 26, (which is drilled in the central portion of end plate 23). As shown in FIGS. 2A and 2B, the inner end of the annular wall 24 preferably has a taper 27, but it may have a suitably curved shape. As is shown on the right side of the FIG. 1, the stationary scroll member 21 is attached to the upper surface of the frame 14 at the periphery of the annular wall 24 by a plurality of bolts 28. The bolts 28 also attach a cap 29 against the upper surface of the stationary scroll member 21. The cap 29 defines a space 30 between its lower surface and the upper surface of the stationary scroll member 21 such that the space 30 has a specified volume. As is shown on the right side of FIG. 1, the cap 29 is provided with a small hole 31 to connect the space 30 with an upper space 112 (to be described later) at the top inside the housing 11. As is shown on the left side of FIG. 1, the cap 29 also has a small hole 32 for guiding lubricating oil (described later).

Figure 3A:
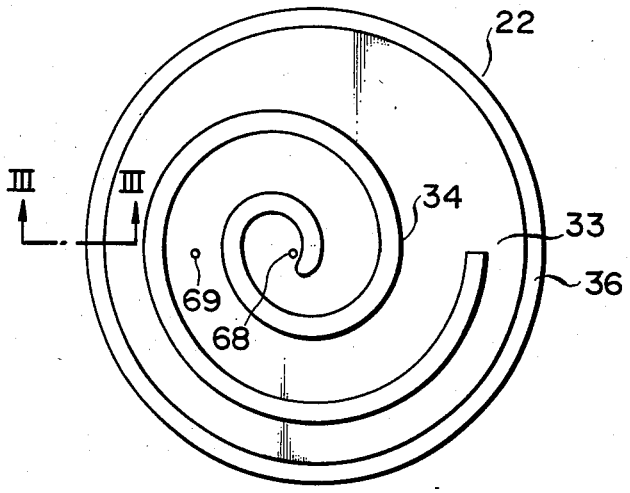
FIG. 3A is a plan view of the orbiting scroll member shown in FIG. 1.
Figure 3B:
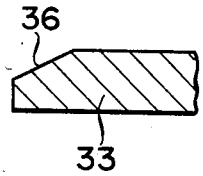
FIG. 3B is a partial cross section of the orbiting scroll member along the line III—III in FIG. 3A as seen in the direction of the arrow.

The orbiting scroll member 22 is constructed of a disc-shaped end plate 33 (which is slightly larger in diameter than the inner diameter of the annular wall 24 of the stationary scroll member 21), an orbiting wrap 34 (which is substantially the same height as the stationary wrap 25 of the stationary scroll member 21 and which projects upwardly from the end plate 33), and a cylindrical portion 35 (which projects downwardly from substantially the central portion of the lower surface of the end plate 33). As is shown in FIGS. 3A and 3B, end the plate 33 has a taper 36 at its outer periphery.

As is shown in FIG. 1, the orbiting scroll member 22 is slidably attached to the stationary scroll member 21 and, in this state, the orbiting wrap 34 of the orbiting scroll member 22 is fitted with the stationary wrap 25 of the stationary scroll member 21 to define a compression chamber P. Also, the peripheral edge of the end plate 33 is in contact with the lower surface of the annular wall 24 of the stationary scroll member 21, the upper surface of the orbiting wrap 34 is in contact with the lower surface of the end plate 23 of the stationary scroll member 21, and the upper surface of end the plate 33 is in contact with the lower surface of the stationary wrap 25 of the stationary scroll member 21. Furthermore, an Oldham mechanism 40 is provided between the end plate 33 of the orbiting scroll member 22 and the frame 14. With this kind of attachment arrangement, orbiting scroll member 22 is kept parallel in relation to the stationary scroll member 21.

Figure 4:
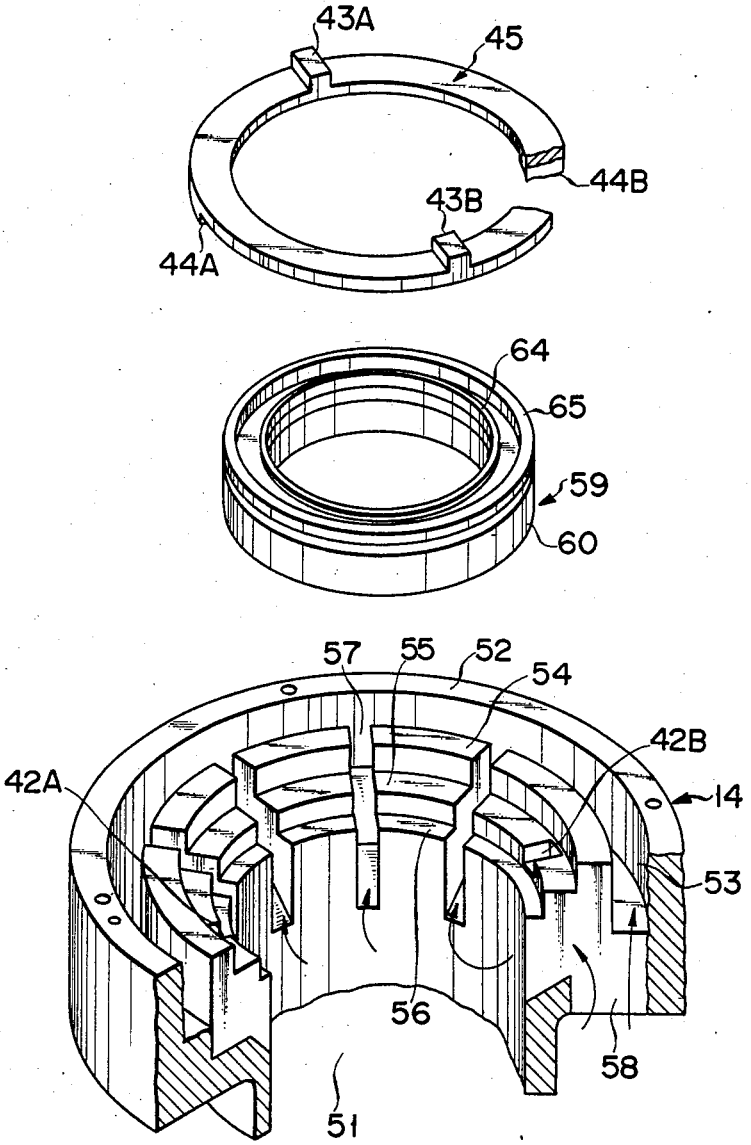
FIG. 4 is a partially cutaway exploded perspective view of the upper part of the frame of the scroll compressor of FIG. 1.

The Oldham mechanism 40 is constructed of two keys slots 41A, 41B on the lower surface of the periphery of the end plate 33, keys slots 42A, 42B on the upper surface of the frame 14 (as shown in the lower part of FIG. 4), and a ring 45 (which is shown in the upper part of FIG. 4). The key slots 41A, 41B are on a straight line which passes through the center of the end plate 33, and the key slots 42A, 42B are on a straight line which passes through the center of the end plate 33 and which is perpendicular to the straight line of the key slots 41A, 41B. Keys 43A, 43B are located on top of the ring 45, and keys 44A, 44B are located at the bottom. These keys respectively fit into the key slots 41A, 41B in the end plate 33 of the orbiting scroll member 22 and the key slots 42A, 42B in the frame 14.

Figure 5:
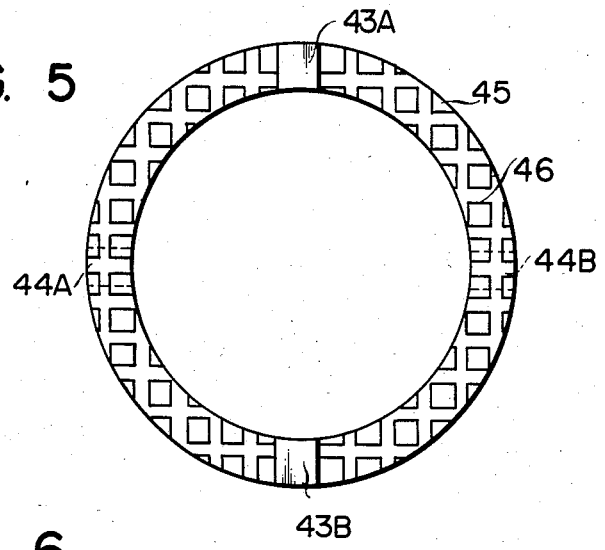
FIG. 5 is a plan view of the main parts of the Oldham mechanism.
Figure 6:
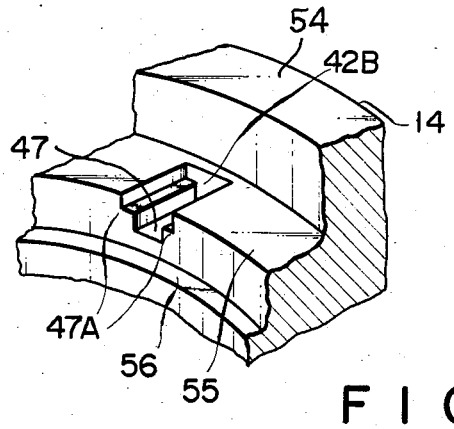
FIG. 6 is a perspective view of the frame showing the key groove of the Oldham mechanism of FIG. 5.

As shown in FIG. 5, in actual practice, net-shaped grooves 46 are formed in both sides of the ring 45 to reduce the contact resistance. A depression 47 (shown in FIG. 6), which has a width less than that of the key slots 41A, 41B, 42A, 42B, is provided in the lower surface of each key slot 41A, 41B and in the upper surface of each key slot 42A, 42B. The depressions 47 provide each slot with a step 47A on each side of the slot. This reduces the sliding area of the slots and their keys.

Referring once more to FIG. 1, a bearing hole 51 is provided passing through the frame 14. The bearing hole 51 is at a position offset from the axis of the cylindrical portion 35 of the orbiting scroll member 22.

As is shown in the lower portion of FIG. 4, the frame 14 has an outermost annular wall 52 which is attached to the annular wall 24 of the stationary scroll member 21 by the bolts 28 shown in FIG. 1. As can be seen in FIG. 1, the outer diameter of the annular wall 52 is substantially the same as the inner diameter of the central portion 12 of the housing 11, while the inner diameter of the annular wall 52 is larger than the outer diameter of the annular wall 24 of the stationary scroll member 21. As shown in FIG. 4, the frame 14 has an annular groove 53 on the inside of annular wall 52, and a stepped structure. Namely, the frame 14 has a first annular step 54 for supporting the periphery of the end plate 33 of the orbiting scroll member 22, a second annular step 55 for supporting the ring 45 of the Oldham mechanism 40, and a third annular step 56 for supporting a thrust reduction mechanism 59 (to be described later). The inner periphery of the third annular step 56 adjoins the inner surface of the bearing hole 51.

Radial slots 57 are formed in the first, second, and third annular steps 54, 55, 56. At least one of the radial slots 57 communicates with through holes 58, which pass through the frame 14. The through holes 58 connect a lower space L and a lower space 110 at the lower portion of housing 11. The space L is enclosed by the side surface of the orbiting scroll member 22, the lower surface of the annular wall 24 of the stationary scroll member 21, and the upper surface of the frame 14, including the inner side surface of the annular wall 52.

Figure 7A:
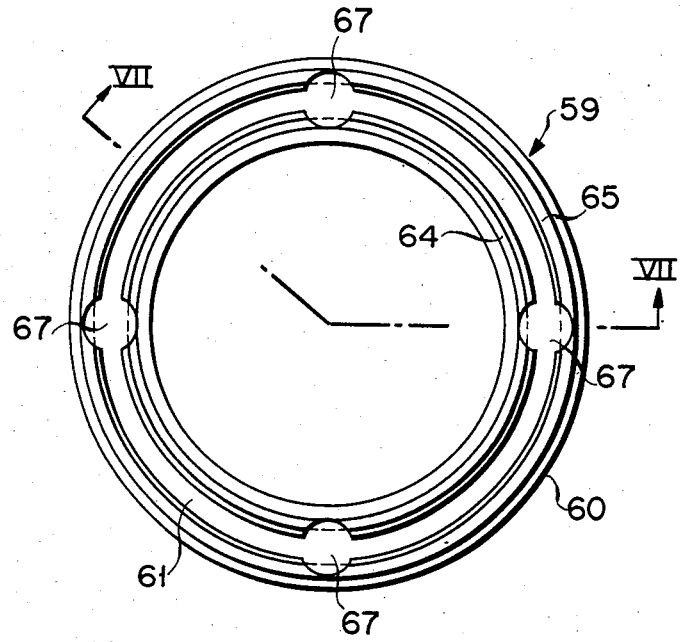
FIG. 7A is a plan view of the thrust reduction mechanism included to the scroll compressor.
Figure 7B:
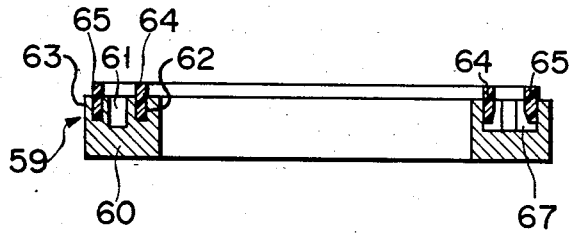
FIG. 7B is a cross section of the thrust reduction mechanism along the line VII—VII of FIG. 7A as seen in the direction of the arrow.
Figure 7C:
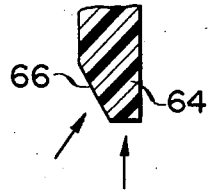
FIG. 7C is a partial cross section showing the seal ring in the thrust reduction mechanism of FIG. 7A.

FIGS. 7A, 7B, and 7C show the pressure receiving means or the thrust reduction mechanism 59. It is constructed of an annular body 60 (which is received in the second annular step 55), an annular groove 61 formed in the upper surface of the annular body 60, annular grooves 62, 63 formed inside and outside of the annular groove 61, respectively, and seal rings 64, 65 received in the annular grooves 62, 63, respectively. The annular grooves 62, 63 are shallower than the annular groove 61. The seal rings 64, 65, which are made of tetrafluoroethylene, are attached to the annular grooves 62, 63 and project upwardly from the upper surface of the annular body 60. Also, as can be seen in FIG. 7C, each of the seal rings 64, 65 has a taper 66 on its lower peripheral edge. Axial holes 67 are formed in four equally spaced locations in the annular groove 61. The axial holes 67, which have a diameter larger than the width of the annular groove 61, connect the annular groove 61 and the annular grooves 62, 63.

As is shown in FIG. 1, connecting passages 68, 69, which connect a high pressure port H and a medium pressure port M of the compression chamber P with an annular space Q, are formed inside the end plate 33 of the orbiting scroll member 22. The compression chamber P is defined by the stationary wrap 25 and the orbiting wrap 34 during the orbiting motion of the orbiting scroll member 22 (to be described later). The annular space Q is enclosed by the annular body 60 and the seal rings 64, 65 of the thrust reduction mechanism 59 and the lower surface of the end plate 33 of the orbiting scroll member 22.

The bearing hole 51 of the frame 14 rotatably supports a drive shaft 70 of the motor 16. The drive shaft 70 has a large diameter portion 71 which is received in the large diameter portion of the frame 14. At the upper part of the large diameter portion 71 there is a small diameter shaft 72 which is fitted into the cylindrical portion 35 of the orbiting scroll member 22. The drive shaft 70 is long enough to be immersed in the lubricating oil 17 at the bottom and is supported at its bottom by a lower bearing 73.

The lower bearing 73 has a bearing support member 74 and a lower bearing main body 75. The lower bearing main body 75 is attached to the bearing support member 74 such that it can be microadjusted. The bearing support member 74 is formed by pressing or casting a round plate. It has a wall 76 around its periphery which is substantially the same diameter as the inside of the central portion 12 of the housing 11. The wall 76 extends along the axis of the housing 11. The central portion of the bearing support member 74 has a large diameter through hole 77 around which are located a plurality of axial through holes 78. The bearing support member 74 is spot welded to the central portion 12 of the housing 11. The lower bearing main body 75 has a cylindrical portion 79 which extends axially, an internal annular section 80 which extends radially inwardly from the lower portion of the cylindrical portion 79, and an external annular section 81 which extends radially outwardly from the lower portion of the cylindrical portion 79. The cylindrical portion 79 supports the radial load component which arises from the lower portion of the drive shaft 70, and the internal annular section 80 supports part of the thrust load which arises from the lower portion of the drive shaft 70. The external annular section 81 has an outer shape larger than the diameter of the large diameter through hole 77 of the bearing support member 74. The external annular section 81 of the lower bearing main body 75 is fastened to the bearing support member 74 by a plurality of bolts 82. The diameter of the through holes for the bolts 82 is larger than that of the bolts. Accordingly, it is possible to attach the lower bearing main body 75 to the bearing support member 74 such that the lower bearing main body 75 is microadjustable.

As shown in FIG. 1, a passage 90 is formed inside the drive shaft 70 for the lubricating oil 17. The lubricating oil 17 is lifted from the bottom of the housing 11 and delivered to the bearing portion between the drive shaft 70 and the bearing hole 51 of the frame 14 and the bearing portion between the small diameter shaft 72 and the cylindrical portion 35 of the orbiting scroll member 22 via the passage 90 by action of the centrifugal pump.

The passage 90 has three sections: a first section 91, which is the inlet for the passage 90 and extends axially from the bottom end of the drive shaft 70; a second section 92, which extends radially from the first section 91; and a third section 93, which connects at right angles with the second section 92 and extends axially along the outer periphery of the drive shaft 70.

The motor 16 is a squirrel-cage induction motor having a rotor 100 inside and a stator 101 outside. The stator 101 is fastened to the inside surface of the central portion 12 of the housing 11. A balance weight 102 is attached to the upper end of the rotor 100. Between the balance weight 102 and the frame 14, a ratchet type reverse prevention mechanism 103 is provided.

Figure 8:
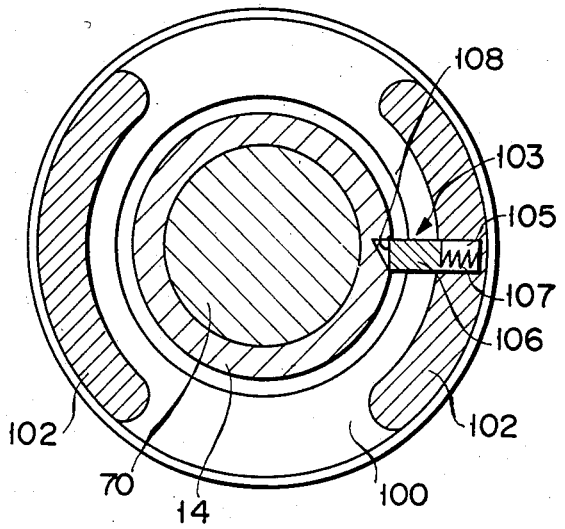
FIG. 8 is an enlarged cross section of the reverse prevention mechanism of the scroll compressor.

The following is a description of the reverse prevention mechanism 103 with reference to FIG. 8. A hole 105 has a bottom and extends radially from the inside surface of the balance weight 102. A rod 106 is slidably housed inside the hole 105 as a stopper with a spring 107 between the bottom of the hole 105 and the rod 106. A cavity 108 is cut into the outer surface of the frame 14. To rotate the drive shaft 70 only in one direction, the end of the rod 106 facing the inside rubs against the drive shaft 70 and engages the cavity 108. The reverse prevention mechanism 103, which is provided between the motor 16 and the drive shaft 70, ensures that there is no reverse motion of the orbiting scroll member 22 of the scroll compressor, even when the motor 16 is stopped.

Once more referring to FIG. 1, a suction pipe 111 is formed in the central portion 12 of the housing 11. The suction pipe 111 is connected to the lower space 110 between the motor 16 and the scroll compressing until 15. A discharge pipe 113 is formed in the upper sealing member 13A of the housing 11 and is connected to the upper space 112 between the upper sealing member 13A and the cap 29.

A passage 114, shown in the left side of FIG. 1, is formed in the annular wall 24 of the stationary scroll member 21 and in the frame 14 for the purpose of returning lubricating oil from the upper space 112 to the bottom of the housing 11. A balance weight 115 is provided on the large diameter portion of the drive shaft 70, and a connector 116 for power supply to the motor 16 is provided on the central portion 12 of the housing 11. A radial hole 117 in the cylindrical portion 35 of the orbiting scroll member 22 communicates the passage 90 with the Oldham mechanism 40.

The following is a description of the operation of the scroll compressor according to this invention.

When power is supplied to the motor 16, the drive shaft 70 starts to rotate. This rotation is kept smooth by the bearings of the bearing hole 51 and the lower bearing main body 75. The rotation of the drive shaft 70 is transmitted to the orbiting scroll member 22. In the first stage of rotation of the motor 16, the rod 106 of the reverse prevention mechanism 103 slides along the outside of the frame 14. When the rotation has increased to a certain level, centrifugal force drives the rod 106 outwardly against the force of the spring 107, so that the rod 106 is completely out of contact with the frame 14. The drive shaft 70 causes the orbiting scroll member 22 to orbit around the axis of the drive shaft 70. Namely, the drive shaft 70 causes a starting end of the orbiting scroll member 22 to rotate around the drive shaft 70. However, the entire body of the orbiting scroll member 22 itself does not rotate, and its location with respect to the drive shaft 70 does not change. This is because the small diameter shaft 72 is eccentric to the drive shaft 70 and is fitted into the cylindrical portion 35 of the orbiting scroll member 22, while at the same time being supported by the Oldham mechanism 40. Accordingly, the orbiting wrap 34 of the orbiting scroll member 22 also generates the orbiting motion. This orbiting motion causes the volume of the compression chamber P defined by the stationary wrap 25 of the stationary scroll member 21 and the orbiting wrap 34 of the orbiting scroll member 22 to cyclically decrease, which causes compressed gas to discharge from the discharge port 26 to the space 30 between the upper surface of the stationary scroll member 21 and the cap 29. The discharged high pressure gas is sent out from the discharge pipe 113 via the hole 31 in the cap 29 and the upper space 112 between the cap 29 and the upper sealing member 13A fo the housing 11.

When the orbiting scroll member 22 orbits around the axis of the drive shaft 70, there is the advantage that a passage is formed between the annular space L (which is defined by the inner surface of the annular wall 52 of the frame 14, the first annular step 54 of the frame 14, and the lower surface of the annular wall 24 of the stationary scroll member 21) and the peripheral edge of the compression chamber P. The reason for this is that the taper 36 at the upper peripheral edge of the end plate 33 of the orbiting scroll member 22 and the taper 27 at the inner peripheral edge of the annular wall 24 of the stationary scroll member 21 permit cyclical communication of the annular space L and the compression chamber P, as shown at the left in FIG. 1. The annular space L connected with the lower space 110, which is connected to the suction pipe 111, via the through holes 58 in the frame 14. Accordingly, low pressure gas from the outside is sucked into the compression chamber P via the suction pipe 111, the lower space 110, the through holes 58, and the annular space L. In this case, the low pressure gas, which flows from the suction pipe 111, may be mixed with the fluid of a cooling medium. During the time when the low pressure gas is moving to the inside of the lower space 110, the fluid drops downwardly due to gravity i.e., this fluid moves to the bottom from which lubricating oil is supplied. The heat generated by the motor 16 vaporizes the falling fluid, which mixes with the already vaporized rising flow in the lower space 110, and the vapor flows to the compression chamber P. In other words, the lower space 110 has the same function as an air/liquid separator.

The following is a description of the lubricating system according to the invention.

When the motor 16 starts to rotate, the lubricating oil 17 is sucked up the passage 90 by the action of the centrifugal pump. The lubricating oil 17 lubricates the inside surface of the bearing hole 51, the gap between the small diameter shaft 72 of the drive shaft 70 and the cylindrical portion 35 of the orbiting scroll member 22, and the Oldham mechanism 40 via the radial hole 117 in the cylindrical portion 35 of the orbiting scroll member 22, after which part of the lubricating oil 17 drops through the through holes 58 and the remainder passes through the annular space L and enters the compression chamber P, thereby lubricating the sliding surfaces inside the compression chamber P. Lastly, the lubricating oil 17 passes through the compression chamber P and is discharged through discharge port 26, after which it flows down through the hole 32 in the cap 29 and the passage 114 in the stationary scroll member 21 and the frame 14. Accordingly, the high pressure gas flowing from the discharge pipe 113 never includes any lubricating oil 17.

The following is a description of the operation of the thrust reduction mechanism.

As was described above, when the compressing action is started by the orbiting motion of the orbiting scroll member 22, the pressure in the compression chamber P increases, and the orbiting scroll member 22 receives a downward thrust. This thrust acts on the Oldham mechanism 40, the first annular step 54 of the frame 14, and the thrust reduction mechanism 59. However, the annular space Q of the thrust reduction mechanism 59 is connected with the high pressure port H and the medium pressure port M of the compression chamber P via the connecting passages 68, 69. Because of the gas pressure inside the annular space Q, the end plate 33 of the orbiting scroll member 22 receives an upward force and, because of this force, the downward thrust on the end plate 33 is largely compensated for. Accordingly, it is possible to prevent the intake increase, seizure, and leakage of compressed gas that is caused by this thrust in prior art device. Also, when this scroll compressor is arranged in a freezing cycle and the fluid of the cooling medium is compressed in the compression chamber P, the fluid at the stage of the medium pressure port M is discharged through the high pressure port H via the connecting passage 69, the annular space Q, and the connecting passage 68. Accordingly, damage to the wraps 25, 34 of the scroll members 21, 22 resulting during the compression period of the cooling medium is prevented. This is clarified in FIGS. 9A to 9H.

Figure 9A:
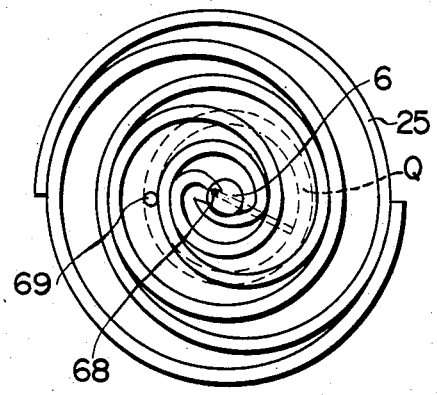
FIGS. 9A to 9H are schematic drawings showing the operation of the wraps of the scroll member, and the positional relationship of the two passages between the annular space of the compression chamber and the thrust reduction mechanism.
Figure 9B:
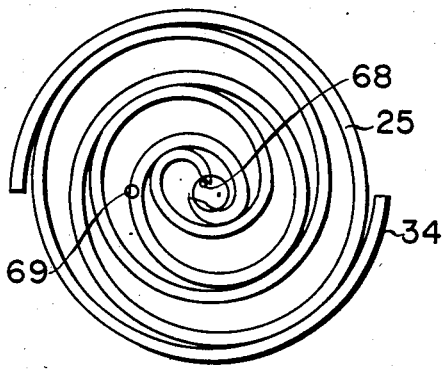
Figure 9C:
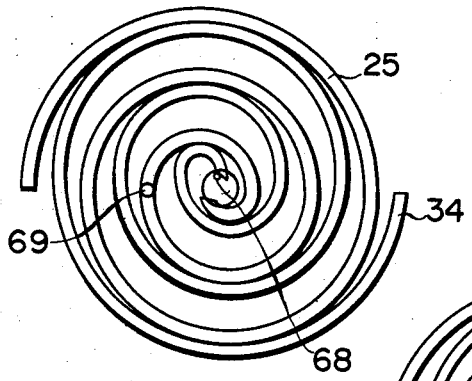
Figure 9D:
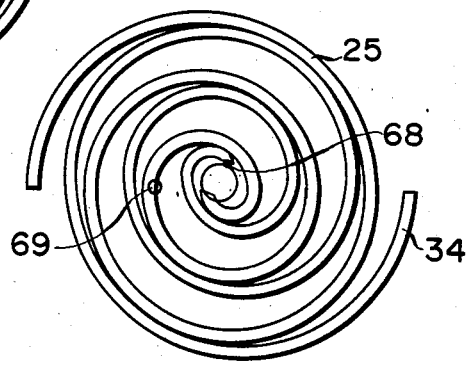
Figure 9E:
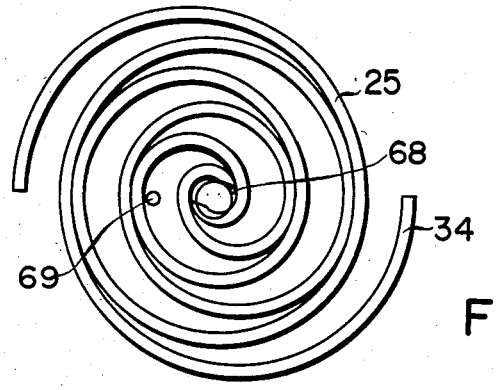
Figure 9F:
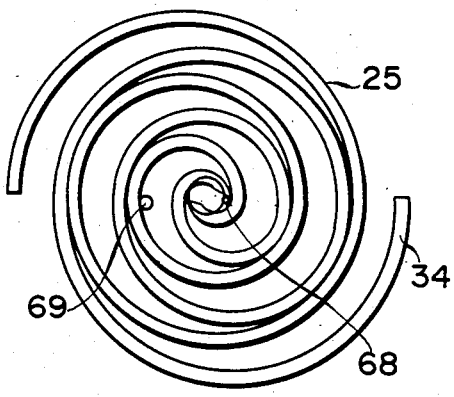
Figure 9G:
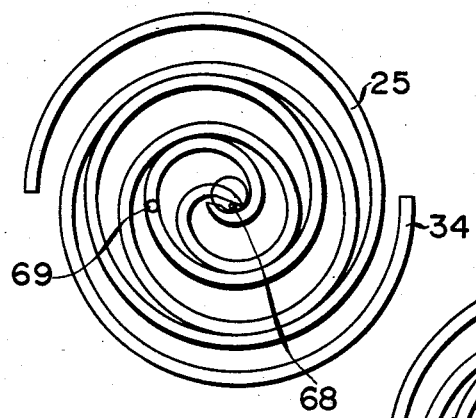
Figure 9H:
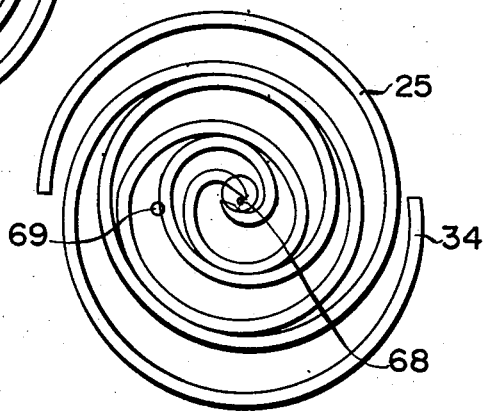

FIGS. 9A to 9H show the positional relationship of the wraps 25, 34 and the openings of the passages 68, 69 in the compression chamber P in one compression cycle. FIG. 9A shows the starting point of compression, FIG. 9H shows the completion point of compression, and the other figures show the various stages in between. As can be seen, the medium pressure port M communicates with the high pressure port H via the annular space Q at nearly all times.

Furthermore, the downward thrust acting on the orbiting scroll member 22 pulsates slightly with the variation corresponding to the position of the compression space. As shown in FIG. 7A, in the thrust reduction mechanism 59 the axial holes 67 of the annular body 60 communicate with the internal and external annular grooves 62, 63 so, as shown by the arrows in FIG. 7C, the force pressing down on the lower surface of the end plate 33 of the orbiting scroll member 22 acts on the seals rings 64, 65, thereby preventing the leakage of high pressure gas.

When the motor 16 stops, the pressure difference between the upper space 112 and the lower space 110 would cause the orbiting scroll member 22 to orbit in the opposite direction, so that the high pressure flows into the low pressure atmosphere of the lower space 110. However, the reverse prevention mechanism 103 prevents this reverse movement.

Figure 10:
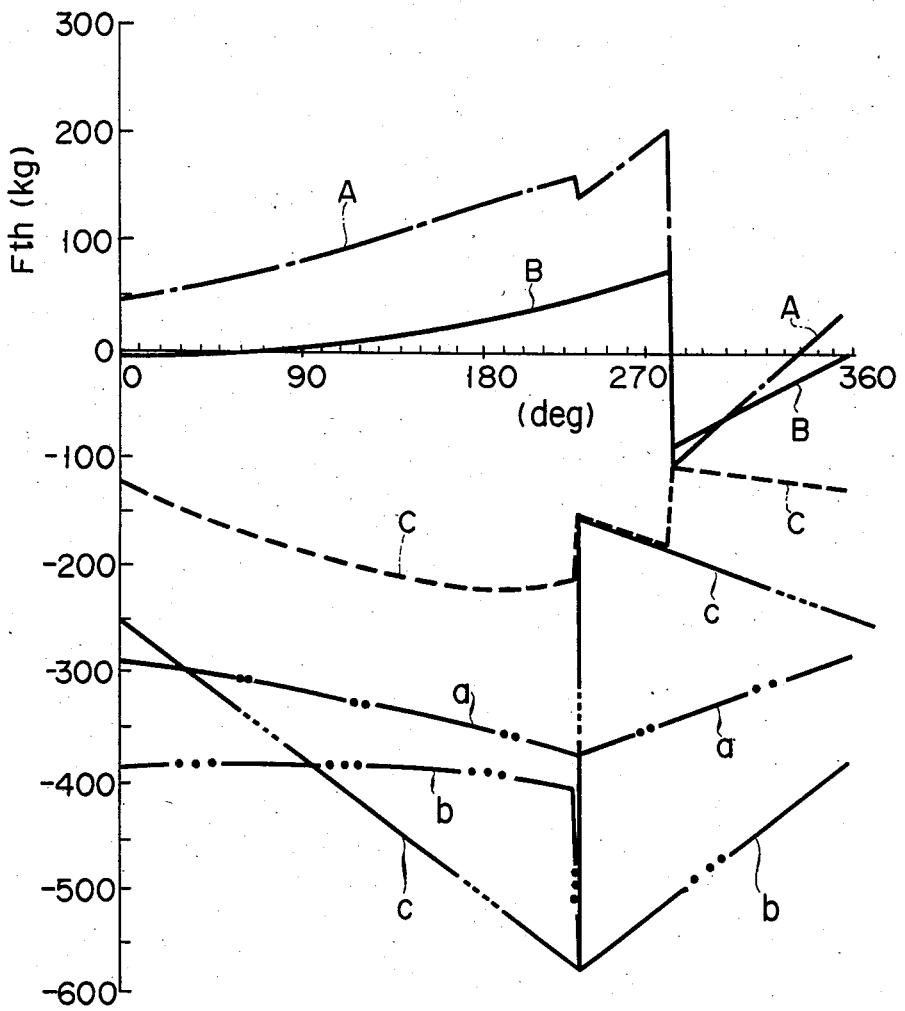
FIG. 10 is a graph showing the measured value of the thrust on the orbiting scroll member with the scroll compressor of this invention with a thrust reduction mechanism, compared to the prior art scroll compressor without a thrust reduction mechanism.

FIG. 10 shows the thrust values when the invention, which uses the above thrust reduction mechanism 59, is applied to a scroll compressor. In the drawing, the symbol A shows the resultant thrust when the discharge pressure is 32 $kg/cm^2$ and the suction pressure is 5.4 $kg/cm^2$. The symbol B shows the result when the discharge pressure is 21 $kg/cm^2$ and the suction pressure is 5.4 $kg/cm^2$. The symbol C shows the result when the discharge pressure is 10 $kg/cm^2$ and the suction pressure is 10 $kg/cm^2$. For the purpose of comparison, the respective letters a, b, c are for the values when a thrust reduction mechanism is not used. As is clear, the downward thrust on the orbiting scroll member 22 is greatly reduced.

The following is a description of a variation on the thrust reduction mechanism of this invention with reference to FIGS. 11 and 12A to 12C. The same reference numerals have been used for the same parts as in the first embodiment.

Figure 11:
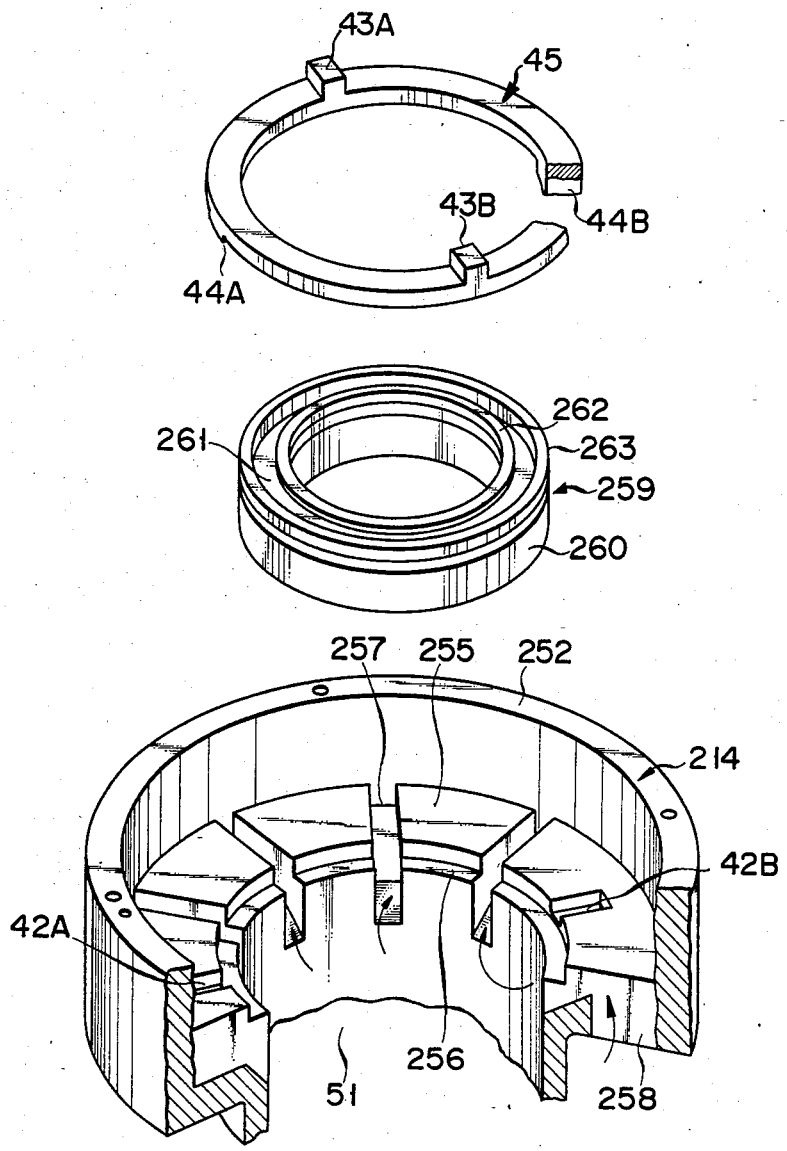
FIG. 11 is a partially exploded perspective view of the upper part of the frame of a scroll compressor, according to a second embodiment of the invention, which has a variation of the thrust reduction mechanism of the first embodiment.

In FIG. 11 of the variation, a frame 214 is the same as the frame 14 in FIG. 4 only with a simplified construction. The first annular step 54 for supporting the end plate 33 of the orbiting scroll member 22 is not formed in the frame 214 and, accordingly, it does not have an annular groove 53 formed on the inside of the annular wall 52. However, the same as in the first embodiment, the frame 214 has a first annular step 255 for supporting the ring 45 of the Oldham mechanism 40 and a second annular step 256 for supporting a thrust reduction mechanism 259. The frame 214 has radial slots 257 and through holes 258.

Figure 12A:
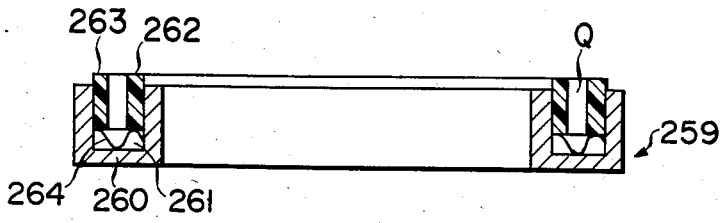
FIG. 12A is a vertical cross section of the thrust reduction mechanism shown in the center of FIG. 11.
Figure 12B:
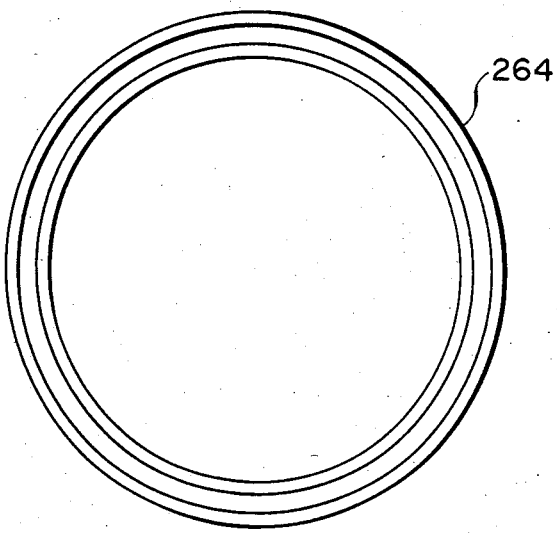
FIG. 12B is a plan view of the flat spring attached to the thrust reduction mechanism of FIG. 12A.
Figure 12C:
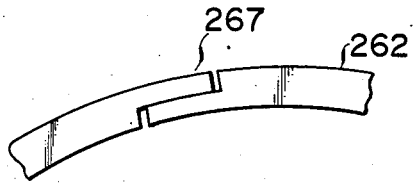
FIG. 12C is a plan view of the seal ring of the thrust reduction mechanism of FIG. 12A.

As is shown in the middle of FIG. 11 and in FIGS. 12A to 12C, the thrust reduction mechanism 259 of this embodiment is constructed of an annular body 260 which is supported by the second annular step 256 of the frame 214, an annular groove 261 which is formed in the upper surface of the annular body 260, internal and external seal rings 262, 263 which are in contact with the internal and external surfaces of the annular groove 261, and a ring-shaped flat spring 264 which is interposed between the bottom of the annular groove 261 and the internal and external seal rings 262, 263. The flat spring 264 has the function of pressing the seal rings 262, 263 in the axial direction. The seal rings 262, 263 are, as in the first embodiment, also made of tetrafluoroethylene, and they partially protrude from the upper surface of annular body 260. Furthermore, the height of the seal rings 262, 263 in the axial direction is less than the depth of the annular groove 261. As shown in FIG. 12C, the seal rings 262, 263 have cut away portions 267 on the periphery, the ends of which overlap and couple. A gap is formed in the circumferential direction between the ends of the cut away portions. These cut away portions 267 may be concave and convex shaped.

Figure 13:
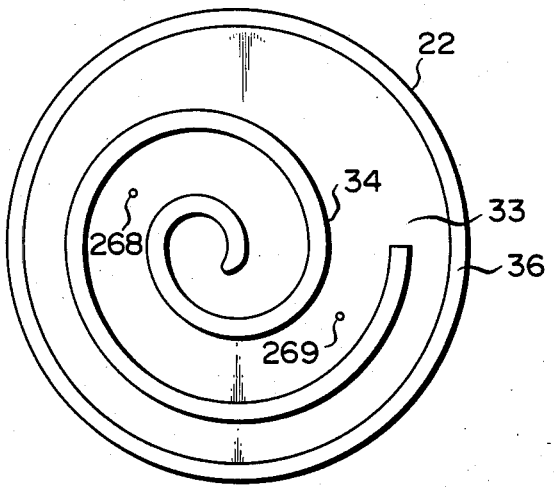
FIG. 13 is a plan view of the same orbiting scroll member as in FIG. 3C.

As shown in FIG. 13, passages 268, 269, provided in the orbiting scroll member 22, are opened to the upper surface of the end plate 33 at different positions from that in FIG. 3C.

The following is a description of the operation of the thrust reduction mechanism 259 of this embodiment.

When the motor 16 starts, the pressure from the compression chamber P results in a downward thrust on the orbiting scroll member 22, which causes it to move downward. This downward movement of the orbiting scroll member 22 causes the internal and external seal rings 262, 263 to move down into the annular groove 261. At this stage, the thrust on the orbiting scroll member 22 is supported by the upper surface of the annular body 260. Next, when the annular groove 261 is covered by the lower surface of the end plate 33 of the orbiting scroll member 22, the annular space Q is connected to the high pressure port H and the medium pressure port M of the compression chamber P via the passages 268, 269. As a result of this, the pressure in the annular space Q rises. This increase in pressure puts pressure on the internal and external seal rings 262, 263 such that they rise facing the end plate 33 of the orbiting scroll member 22. As a result, the seal rings 262, 263 contact the lower surface of the end plate 33 at their upper ends. The flat spring 264 is biased by this upward pressure. Consequently, the gas is completely prevented from leaking from the annular apace Q. As a result, the pressure in the annular space Q increases even more. Accordingly, the end plate 33 of the orbiting scroll member 22 receives the upward pressure from the gas pressure in the annular space Q. This pressure compensates for the downward thrust on the end plate 33 and, consequently, seizure is prevented.

In this embodiment, the same as in the first embodiment, the seal rings 262, 263 slide in the axial direction in the annular groove 261 with the vibration of the orbiting scroll member 22. At this time, heat due to the friction between the end plate 33 and the seal rings 262, 263 causes the periphery of the seal rings to expand. In this embodiment, this peripheral expansion is absorbed by the cut away portions 267 and, accordingly, the leakage of high pressure gas is prevented.

According to this invention, the annular groove of the thrust reduction mechanism may be formed in the underside of the orbiting scroll member and not in the annular body, as was the case in the first embodiment. Also, the annular body of the thrust reduction mechanism need not be formed separately as in the first embodiment, but may be formed as one with the frame.

This invention is not limited to the above embodiments. For example, in the above embodiment, the motor is arranged under the orbiting scroll member, but this invention may be applied to types where the motor is arranged above the orbiting scroll member or where the drive shaft of the motor is horizontal.

What is claimed is:

1. A scroll compressor with a thrust reduction mechanism for compressing gas, said scroll compressor comprising:

(a) a sealed housing having a discharge port and a suction port;

(b) scroll compressing means located between the discharge and suction ports, said scroll compressing means including a stationary scroll member and an orbiting scroll member defining a compressing chamber therebetween which communicates with the discharge port, whereby, during operation, a lower pressure fluid is introduced from the suction port into said sealed housing to fill it with the lower pressure fluid and part of the fluid in said sealed housing is introduced into the compression chamber, compressed therein, and discharged from the discharge port through the discharge outlet;

(c) means arranged in said sealed housing to cause said orbiting scroll member to orbit, thereby compressing the fluid introduced into the compression chamber;

(d) connecting means penetrating said orbiting scroll member to communicate the compression chamber with the inside of said sealed housing;

(e) pressure receiving means provided in said sealed housing adjacent said orbiting scroll member in position to be exposed to the lower pressure fluid, said pressure receiving means receiving compressed fluid from the compression chamber through said connecting means, whereby, during operation, the compressed fluid in said pressure receiving means gives a thrust load to said orbiting scroll member, thereby partially compensating for the force exerted on said orbiting scroll member by the compression chamber;

(f) a frame fixed to said sealed housing to transmit the thrust load to said sealed housing, said frame supporting said pressure receiving means, whereby, during operation, the thrust load applied to said pressure receiving means is transmitted to said sealed housing through said frame; and (g) supporting means for preventing said pressure receiving means from orbiting together with said orbiting scroll member.

2. A scroll compressor according to claim 1 wherein said supporting means includes a peripheral surface having an inner diameter substantially equal to the outer diameter of said pressure receiving means, thereby permitting said supporting member to be always in contact with the the outer peripheral surface of said pressure receiving surface.

3. A scroll compressor with a thrust reduction mechanism for compressing gas, said scroll compressor comprising:

(a) a sealed housing having a discharge port and a suction port;

(b) scroll compressing means located between the discharge and suction ports, said scroll compressing means including a stationary scroll member and an orbiting scroll member defining a compression chamber therebetween which communicates with the discharge port, whereby, during operation, a lower pressure fluid is introduced from the suction port into said sealed housing to fill it with the lower pressure fluid and part of the fluid in said sealed housing is introduced into the compression chamber, compressed therein, and discharged from the discharge port through the discharge outlet;

(c) means arranged in said sealed housing to cause said orbiting scroll member to orbit, thereby compressing the fluid introduced into the compression chamber;

(d) connecting means penetrating said orbiting scroll member to communicate the compression chamber with the inside of said sealed housing;

(e) circular pressure receiving means adjacent said orbiting scroll member having a thrust-transmitting surface provided in said sealed housing in position to be exposed to the lower pressure fluid, said circular pressure receiving means receiving compressed fluid from the compression chamber through said connecting means, whereby, during operation, the compressed fluid in said circular pressure receiving means gives a thrust load to said orbiting scroll member, thereby partially compensating for the force exerted on said orbiting scroll member by the compression chamber, said circular pressure receiving means having a outer peripheral surface and a central axis eccentric to the center of said orbiting scroll member; and (f) a frame fixed to said sealed housing to transmit the thrust load to said sealed housing, said frame comprising a thrust-receiving surface in surface-to-surface contact with the thrust-transmitting surface of said circular pressure receiving means to therebetween prevent said pressure receiving means from orbiting in spite of the motion of said orbiting scroll member and an inner peripheral surface which is in contact with the outer peripheral surface of sad pressure receiving means, whereby, during operation, the thrust load applied to said circular pressure receiving means is transmitted to said sealed housing through said frame.

4. A scroll compressor for compressing refrigerant, said scroll compressor comprising:

(a) a housing having a discharge port and a suction port;

(b) scroll compressing means located between said discharge and suction ports, said scroll compressing means including:

(i) a stationary scroll member having an end plate, a stationary wrap extending vertically to said end plate, and a discharge outlet opened at a starting end of said stationary wrap and communicating with said discharge port and (ii) an orbiting scroll member having an end plate and an orbiting wrap extending vertically to the end plate of said orbiting scroll member and meshing with the stationary wrap of said stationary scroll member, (iii) the stationary wrap and the end plate of said stationary scroll member together with the orbiting wrap and the end plate of said orbiting scroll member defining a compression chamber therebetween, whereby, during operation, a lower pressure gas is introduced from the periphery of said stationary and orbiting wraps to said compression chamber and discharged from said discharge outlet and a side of the end plate of said orbiting scroll member opposed to said compression chamber is subjected to a low pressure atmosphere;

(c) drive means arranged in the low pressure atmosphere inside said housing, said drive means including a drive shaft attached to said housing for rotation about an axis fixed with respect to said housing, said drive shaft having an axial end adjacent to but spaced from said end plate of said orbiting scroll member;

(d) means for communicating the lower pressure gas to the space between said drive shaft and said end plate of said orbiting scroll member;

(e) rotation transmission means for transmitting rotation of said drive shaft to said orbiting scroll member to cause said orbiting scroll member to orbit;

(f) a frame fastened to said housing and to the periphery of the end plate of said stationary scroll member on the surface on which said stationary wrap extends, said frame having a bearing hole in which said drive shaft is fitted and further comprising a thrust-receiving surface;

(g) Oldham coupling means provided between said frame and said orbiting scroll member for supporting said orbiting scroll member;

(h) connecting means provided in said orbiting scroll member, said connecting means connecting said compression chamber and said low pressure atmosphere within said housing;

(i) pressure receiving means having an annular channel formed therein, said annular channel being disposed between said frame and said orbiting scroll member radially outwardly of said drive shaft for receiving the pressure of said compression chamber via said connecting means, said pressure receiving means comprising a thrust-transmitting surface in surface-to-surface contact with said thrust-receiving surface of said frame to thereby prevent said pressure receiving means from orbiting in spite of the motion of said orbiting scroll member; and (j) lubrication oil connecting means provided inside said drive shaft for connecting the bottom of said housing with the space between said drive shaft and said frame and with the space between said rotation transmission means and said orbiting scroll member.

5. A scroll compressor for compressing refrigerant according to claim 4, wherein said rotation transmission means includes:

(a) a cylindrical portion which projects from the surface of the end plate of said orbiting scroll member opposed to the surface on which said orbiting scroll extends and (b) a small diameter shaft carried by said drive shaft at a position offset from the axis of rotation of said drive shaft, said small diameter shaft fitting into the inside of said cylindrical portion of said orbiting scroll member.

6. A scroll compressor for compressing refrigerant according to claim 5, wherein said pressure receiving means is arranged on an imaginary circle, the center of the imaginary circle being concentric with the axis of rotation of said drive means.

7. A scroll compressor for compressing refrigerant according to claim 6, wherein:

(a) said pressure receiving means includes an annular body provided between said frame and said orbiting scroll member;

(b) said annular channel comprises a groove formed on a surface of said annular body which abuts against said surface of said orbiting scroll member; and (c) said groove is connected with said compression chamber via said connecting means.

8. A scroll compressor for compressing gas according to claim 7, wherein each seal ring of each pair of seal rings includes a cut out portion, the ends of said seal rings are concave or convex, said concave and convex ends coupling, and leaving a space.

9. A scroll compressor for compressing refrigerant according to claim 7, wherein:

(a) said pressure receiving means further includes a pair of seal rings;

(b) the ends of said seal rings abut against the end plate of said orbiting scroll member;

(c) one of said seal rings is in contact with the inner surface of said groove;

(d) the other of said seal rings is in contact with the outer surface of said groove; and (e) the height of said pair of seal rings is less than the depth of said groove.

10. A scroll compressor for compressing refrigerant according to claim 9, wherein:

(a) each seal ring of said pair of seal rings includes a cut out portion;

(b) the ends of said cut out portions are concave or convex; and (c) said concave and convex ends couple, leaving a space.

11. A scroll compressor for compressing refrigerant according to claim 10, wherein said pressure receiving means further includes a spring member attached between the bottom of said groove and said pair of seal rings, said spring member pressing said pair of seal rings against the lower surface of said orbiting scroll member.

12. A scroll compressor with a thrust reduction mechanism for compressing gas, said scroll compressor comprising:

(a) a housing having a discharge port and a suction port;

(b) scroll compressing means located between the discharge and suction ports, said scroll compressing means including:

(i) a stationary scroll member having an end plate, a stationary wrap extending vertically to the end plate, and a discharge outlet formed in the end plate and communicating with said discharge port and (ii) an orbiting scroll member having an end plate and an orbiting wrap extending vertically to the end plate of said orbiting scroll member and meshing with the stationary wrap of said stationary scroll member, (iii) the stationary wrap and the end plate of said stationary scroll member together with the orbiting wrap and end plate of said orbiting scroll member defining a compression chamber therebetween, whereby, during operation, a lower pressure gas is introduced from said suction port in to said housing to fill it with the lower pressure gas and part of the gas in said housing is introduced into said compression chamber from the periphery of said stationary and orbiting wraps, compressed, and discharged from said discharge port through said discharge outlet;

(c) driving means including a drive shaft arranged in said housing, said drive shaft having an axial end adjacent to but spaced from the end plate of said orbiting scroll member;

(d) means for communicating the lower pressure gas to the space between said drive shaft and the end plate of said orbiting scroll member;

(e) rotation transmission means for transmitting rotation of said drive shaft to said orbiting scroll member to cause said orbiting scroll member to orbit;

(f) connecting means penetrating said orbiting scroll member from a first side thereof which defines said compression chamber to a second side thereof which, during operation, is exposed to the lower pressure gas;

(g) a pressure receiving means having an annular channel formed therein, said annular channel being radially outwardly spaced from said drive shaft and facing the second side of said orbiting scroll member, said pressure receiving means comprising a thrust-transmitting surface, said pressure receiving means receiving the compressed gas in said compression chamber through said connecting means, whereby, during operation, the compressed gas in said pressure receiving means gives a thrust load to the end plate of said orbiting scroll member and to said pressure receiving means to separate them; and (h) a frame fixed to said housing to transmit the thrust load to it, said frame comprising a thrust-receiving surface in surface-to-surface contact with the thrust-transmitting surface of said pressure receiving means to thereby prevent said pressure receiving means from orbiting in spite of the motion of said orbiting scroll member, whereby, during operation, the thrust load applied to said pressure receiving means is transmitted to said housing through said frame.

13. A scroll compressor for compressing gas according to claim 2, wherein said pressure receiving means is arranged on an imaginary circle, the center of the imaginary circle being concentric with the axis of rotation of said driving means.

14. A scroll compressor for compressing gas according to claim 13, wherein said pressure receiving means includes an annular member provided between said frame and said orbiting scroll member and said annular channel comprising an annular groove formed in said annular member, said annular groove abutting against the second side of said orbiting scroll member and being connected to said compression chamber via said connector means.

15. A scroll compressor for compressing gas according to claim 14, wherein said said annular channel further includes a pair of seal rings, the ends of said seal rings abutting against the end plate of said orbiting scroll member, a pair of annular grooves is formed inside and outside of said annular groove, said pair of seal rings being partially housed inside said pair of annular grooves, the depth of said pair of said annular grooves being less than that of said annular groove, and said pair of annular grooves connecting, at their bottoms, with the periphery of said annular groove at a plurality of locations.

16. A scroll compressor for compressing gas according to claim 14, wherein said annular member includes an annular body and a pair of seal rings projecting from said annular body to form said annular channel therebetween, the projecting ends of said pair of said seal rings abuting against the end plate of said orbiting scroll member.

17. A scroll compressor for compressing refrigerant according to claim 16, wherein:

(a) said pressure receiving means further includes a pair of seal rings;
(b) the ends of said seal rings abut against the end plate of said orbiting scroll member;
(c) a pair of annular grooves is formed inside and outside of said groove;
(d) said pair of seal rings is partially housed inside said pair of annular grooves;
(e) the depth of said pair of grooves is less than that of said groove; and
(f) said pair of grooves are connected, at their bottoms, with the periphery of said groove at a plurality of locations.

18. A scroll compressor for compressing gas according to claim 8, wherein said pressure receiving means further includes a spring member attached between the bottom of said annular groove and said pair of seal rings, said spring member pressing said pair of seal rings against the second surface of said orbiting scroll member.

19. A scroll compressor with a thrust reduction mechanism for compressing gas, said scroll compressor comprising:
(a) a sealed housing having a discharge port and a suction port;
(b) scroll compressing means located between the discharge and suction ports, said scroll compressing means including a stationary scroll member and an orbiting scroll member defining a compression chamber therebetween which communicates with the discharge port, whereby, during operation, a lower pressure fluid is introduced from the suction port into said sealed housing to fill it with the lower pressure fluid and part of the fluid in said sealed housing is introduced into the compression chamber, compressed therein, and discharged from the discharge port through the discharge outlet;
(c) means arranged in said sealed housing to cause said orbiting scroll member to orbit, thereby compressing the fluid introduced into the compression chamber;
(d) connecting means penetrating said orbiting scroll member to communicate the compression chamber with the inside of said sealed housing;
(e) pressure receiving means comprising a thrust-transmitting surface provided in said sealed housing in position to be exposed to the lower pressure fluid, said pressure receiving means adjacent said orbiting scroll member receiving compressed fluid from the compression chamber through said connecting means, whereby, during operation, the compressed fluid in said pressure receiving means gives a thrust load to said orbiting scroll member, thereby partially compensating for the force exerted on said orbiting scroll member by the compression chamber; and
(f) a frame fixed to said sealed housing to transmit the thrust load to said sealed housing, said frame comprising a thrust-receiving surface in surface-to-surface contact with the thrust-transmitting surface of said pressure receiving means to thereby prevent said pressure receiving means from orbiting in spite of the motion of said orbiting scroll member, whereby, during operation, the thrust load applied to said pressure receiving means is transmitted to said sealed housing through said frame.

* * * * *